US010661457B2

(12) United States Patent
France

(10) Patent No.: US 10,661,457 B2
(45) Date of Patent: May 26, 2020

(54) DUAL BLADE LOCKING MECHANISM

(71) Applicant: Benchmade Knife Co., Inc., Oregon City, OR (US)

(72) Inventor: Jason France, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 0 days.

(21) Appl. No.: 16/110,851

(22) Filed: Aug. 23, 2018

(65) Prior Publication Data

US 2019/0061181 A1 Feb. 28, 2019

Related U.S. Application Data

(60) Provisional application No. 62/549,270, filed on Aug. 23, 2017.

(51) Int. Cl.
*B26B 1/04* (2006.01)

(52) U.S. Cl.
CPC ..... *B26B 1/048* (2013.01)

(58) Field of Classification Search
CPC ..... B26B 1/048
USPC ..... 30/152, 161
See application file for complete search history.

(56) References Cited

U.S. PATENT DOCUMENTS 5,044,079 A * 9/1991 Gibbs ..... B26B 1/042 30/158
5,537,750 A 7/1996 Seber
5,546,662 A * 8/1996 Seber ..... B26B 1/044 30/160
6,101,724 A * 8/2000 Halligan ..... B26B 1/046 30/155
6,789,323 B2 * 9/2004 Moizis ..... B26B 1/044 30/155
RE41,259 E 4/2010 McHenry
7,979,990 B2 * 7/2011 Hawk ..... B26B 1/048 30/155
10,150,221 B1 * 12/2018 Chen ..... B26B 1/044
2007/0169354 A1 * 7/2007 Ralph ..... B26B 1/046 30/160
2013/0318798 A1 12/2013 Elsener
2015/0352730 A1 12/2015 Duey
2015/0352731 A1 12/2015 France
(Continued)

FOREIGN PATENT DOCUMENTS

TW 253273 8/1995
TW 200603967 A 2/2006
(Continued)

*Primary Examiner* — Hwei-Siu C Payer
(74) *Attorney, Agent, or Firm* — Schwabe Williamson & Wyatt P.C.

(57) ABSTRACT

A folding tool including a handle having a first handle half and a second handle half held in a spaced apart relationship to form an implement groove therebetween. Two or more implements are pivotally connected between the first handle half and a second handle half by a pivot shaft and movable between an open position and closed position and lockable in the open position. The folding tool includes a closed blade retention system, with a detent feature (or hole) on each tang, a detent retainer spring, and a detent ball. When the implement is in the closed position, the detent aligns with the ball thereby retaining the blade in the closed position.

13 Claims, 10 Drawing Sheets

(56) References Cited

U.S. PATENT DOCUMENTS

| | | | | |
|---|---|---|---|---|
| 2017/0165849 | A1 | 6/2017 | DeBaker | |
| 2019/0061181 | A1 * | 2/2019 | France | B26B 1/048 |

FOREIGN PATENT DOCUMENTS

| | | |
|---|---|---|
| WO | WO9511116 | 4/1995 |
| WO | WO 2019/040764 A1 * | 2/2019 |

* cited by examiner

DUAL BLADE LOCKING MECHANISM

CROSS-REFERENCE TO RELATED APPLICATION

This application claims the priority benefit of the earlier filing date of U.S. Provisional Application No. 62/549,270, filed Aug. 23, 2017, which is incorporated herein by reference in its entirety.

TECHNICAL FIELD

The present disclosure relates to folding tools, and more particularly, to a folding tool having two or more implements, such as blades, that open independently and use the same locking mechanism to lock the implements in the open position. The tool further includes a retention mechanism that retains one or more implements in the closed position.

BACKGROUND

Multi-blade folding knives are invaluable tools that are used in many aspects of everyday life, and there are many types and styles of folding knives. A "manual" folding knife is a traditional type of tool in which the blade is manually movable by the user between a closed or stowed position in which the sharp edge of the blade is held safely within the handle, and an open position in which the blade is extended in an operable position.

In folding knives having a manual operation, a user opens the blade by grasping the blade or pushing a knob protruding from the blade in order to rotate the blade into the open position. Many folding knives also include mechanisms that lock the blade in the open position, primarily as a safety feature. There are many different types of these locks.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
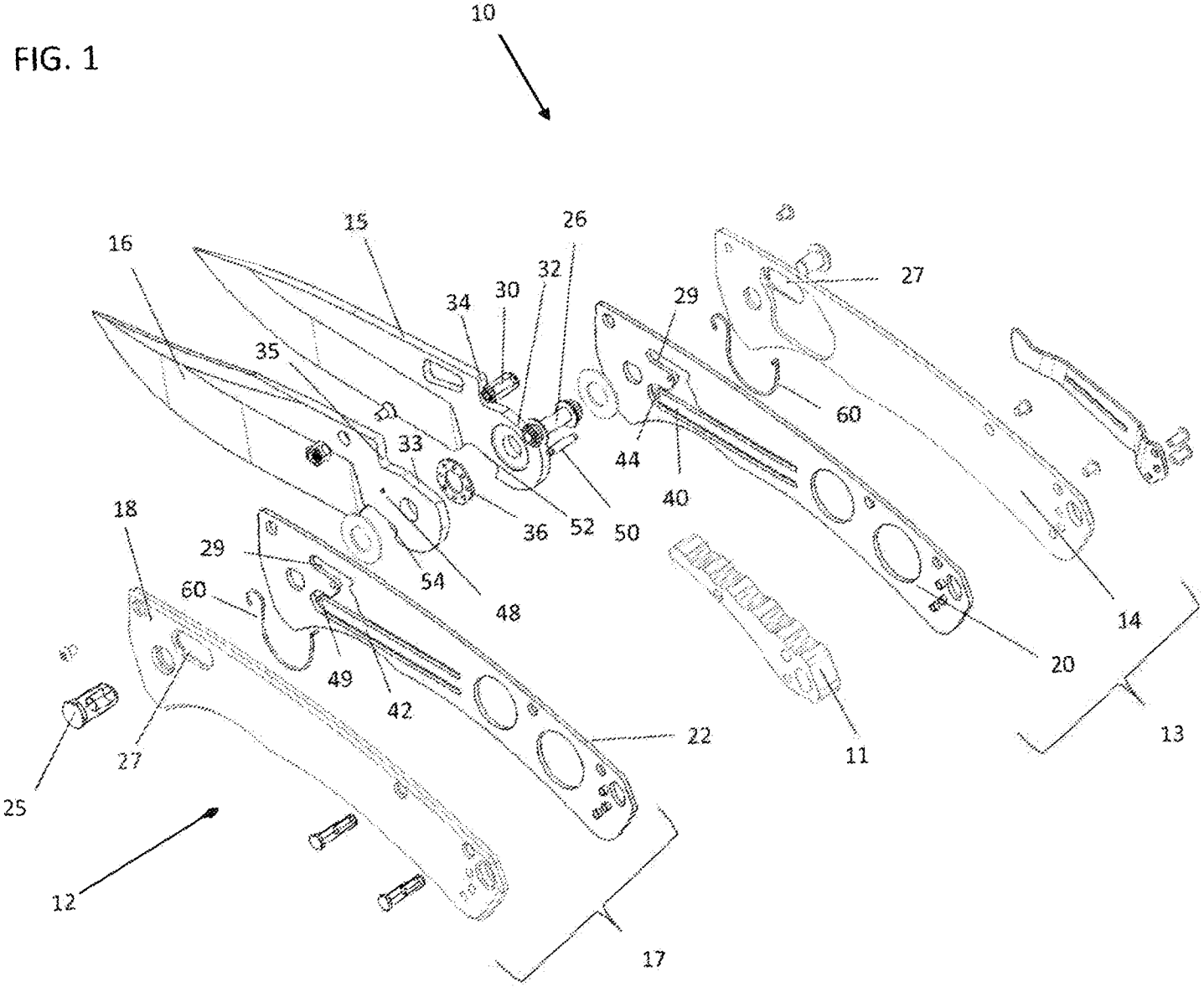
FIG. 1 is a perspective and exploded view of a dual bladed folding knife having an open blade locking mechanism and closed blade retention system, in accordance with various embodiments.
Figure 2:
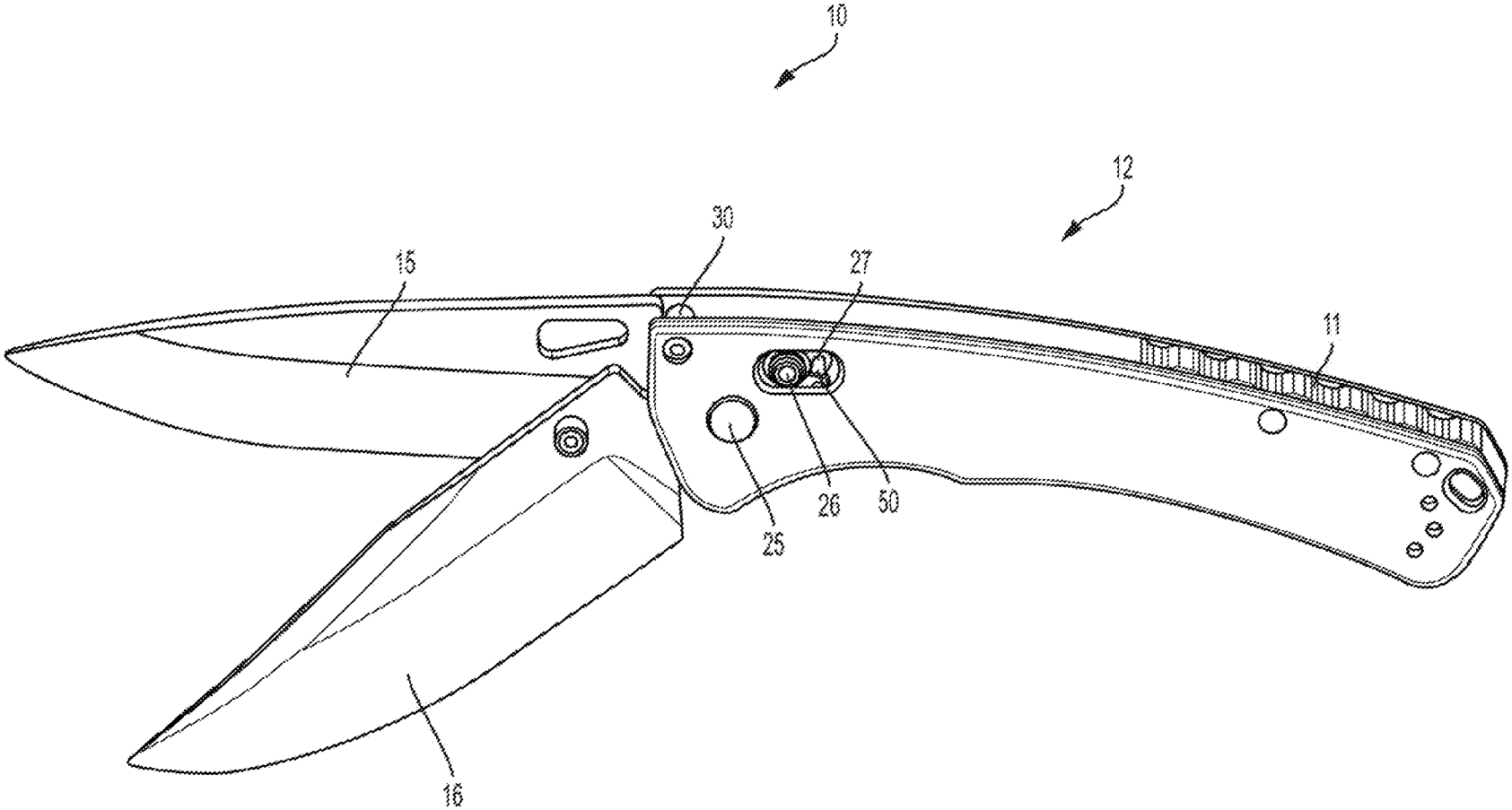
FIG. 2 is a side view of the knife shown in FIG. 1 in an assembled condition with one blade in the locked, open, extended position and the second blade in a partially open position, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

The present disclosure relates to a folding tool having two or more folding implements that can be locked in an open extended position and/or retained in a closed, folded position. In certain embodiments, the folding tool is a folding knife and at least one of the implements is a knife blade. The disclosed tool includes a locking mechanism, for example, an axis lock as described in U.S. Pat. No. RE 41,259, that securely locks one or both of the blades in the open extended position. The folding tool also includes a blade retention mechanism that effectively holds the blades in the closed position so that the blades are not able to swing freely when the tool is closed. This feature is especially important for a knife with two or more blades as when one blade is locked in the open extended position, or being rotated into this position, it is desirable to have the other blade remain in the closed position, both for functionality and safety.

In embodiments, a disclosed folding tool, such as a folding knife includes a handle having a first handle half and a second handle half held in a spaced apart relationship to form an implement groove, such as a blade groove, therebetween. In certain embodiments, the first handle half and the second handle half each include a sidewall and a liner. The folding tool includes two or more implements, such as knife blades, saws, etc. pivotally connected between the first handle half and the second handle half by a pivot shaft. Typically, an implement has a tang and a working portion, such as an extended blade. The tang can be thought of as the butt end and is typically where the implement attaches to the handle halves with the pivot pin. The implements are movable between an open position and closed position. In certain embodiments, movement of the blades relative to each other is facilitated by placement of a bearing or bushing between the tangs of the blades, for example a bearing or bushing disposed about the pivot shaft and between the blades. In certain embodiments the bearing is a thrust bearing.

The folding tool further includes an implement locking mechanism that locks the implements in the open extended position. In certain embodiments, the implement locking mechanism includes a lock bar that is movable between a first position and a second position, wherein the first position locks one or more of the implements in an open position, and moving the lock bar to the second position releases the one or more implements from being locked in the open position. In embodiments, the lock bar is biased to the locked position, for example using one or more springs.

A unique feature of the disclosed folding tool is the inclusion of a closed implement retention system. This closed implement retention system works to keep a closed implement in the closed position and, as described below, works with the locking mechanism to close a partially open implement. In certain embodiments, the closed implement retention system includes a detent hole, or small depression, on the tang of the implement; a detent retainer spring; and a detent ball. When the implement is in the closed position, the detent hole aligns with the detent ball thereby retaining the blade in the closed position. In embodiments, the detent ball is a single, usually metal sphere, sliding within a bored cylinder, against the pressure of a detent retainer spring, which pushes the ball against the tang that carries the detent feature. In embodiments, the detent feature is a hole, for example detent hole, of smaller diameter than the ball. When the hole is in line with the detent ball, the detent ball falls partially into the hole under detent retainer spring pressure. When an opening force is applied to the tang the detent retainer spring compresses, allowing the tang and thus the implement to move from the closed position. The detent retainer spring can be any sort of spring that is able to provide pressure on the detent hole and the detent ball, such as a compression spring or a leaf spring. In certain embodiments, the detent retainer spring is a detent arm, for example a leaf spring having a detent ball coupled thereto, for example a full ball or portion therefore such as hemisphere or portion thereof. In embodiments, the detent arm is coupled to one of the liners. In certain embodiments the detent arm and the liner are a single integral piece of material, and the detent arm is bent away from the plane of the liner to provide the force to the spring. In certain embodiments, the detent arm includes a hole or depression at the distal end wherein the detent ball is retained in the hole. In certain example the detent ball is integral with the spring, such as made form a single piece of material, or otherwise coupled together.

One of the advantages of using the axis lock and the closed blade retention system is that these mechanisms work together to close a partially open blade. By way of example, and as detailed below with respect to FIGS. 6A-6C, the primary suck back from the lock bar rotates the closing blade just enough to engage with the detent ball in the detent arm, before the lock bar locks the open blade. When the lock bar locks the open blade, it stops producing suck back for the closing blade. However, just before this point, it brings the edge of the detent hole on the closing blade's tang past the centerline of the detent ball on the detent arm. The detent hole then finishes the last bit of suck back, and retains the closed blade with the desired bias toward the closed position. In embodiments, the detent retention system exerts between about 1.5 and 2.5 lbs of force. Suck back refers to the lock bar mechanism biasing the blades to the closed position until the blade is rotated past a specific point.

In certain embodiments, the folding tool further includes a closed position stop, wherein the tang of the implement rests against the closed position stop in the closed position and does not rest against the lock bar. The inclusion of this feature keeps the closed blade from resting against the lock bar and interfering with the free movement of the lock bar. In embodiments, the tang comprises a first ramped surface that interacts with the lock bar in the open position. In embodiments, the tang comprises a second ramped surface that interacts with the closed position stop in the closed position.

With reference now to the drawings, a folding knife 10 having dual blades as disclosed is illustrated in FIGS. 1 through 8. The blades open independently and use the same locking mechanism to lock the blades in the open position. The knife 10 further includes a blade retention system that retains one blade in the closed position as the other blade is articulated from a closed position to an open position or locked in the open position.

The knife 10 according to the present disclosure is shown in perspective exploded view in FIG. 1. The knife 10 is shown fully assembled in FIG. 2. As shown in FIG. 1 the folding knife 10 includes an elongate handle 12 that includes a first handle half 13 having a first sidewall 14 and an associated first liner 20 and a second handle half 17 having a second sidewall 18 with its associated second liner 22. The handle further includes a spacer block 11 disposed within handle 12. A first blade 15 and a second blade 16 are pivotally attached to the handle 12 between the first handle half 13 and the second handle half 17 at one end, referred to herein as the "forward" end of the handle 12. The first blade 15 and second blade 16 are pivotally movable about blade pivot pin 25 between the open and closed positions along a blade plane. To allow for smooth movement of the blades 15 and 16 relative to each other a thrust bearing 36 is disposed between the blades 15 and 16 about the pivot pin 25. Other relative directional terms correspond to this convention: the "rear" or butt end of the handle 12 is opposite the forward end; the "upper" part of a blade is the dull, non-working portion and the "lower" part of the blade is the sharpened, working portion; "inner" or "inward" refers to the structural center of the knife, and so on. The X-Y plane is the plane parallel to the plane of the handle 12 and blades 15 and 16. The blades 15 and 16 travel in the X-Y plane as they are rotated between the closed and open positions. The Z plane is the plane transverse to the X-Y—the blade pivot pin 25 extends longitudinally in the Z-plane.

The locking mechanism of the knife 10 includes a lock bar 26 that extends transverse to the plane of the handle 12 and which has its opposite ends extending in slots 27 in sidewalls 14 and 18, which align operationally with paired slots 29 in liners 20 and 22. The lock bar 26 is spring loaded with two U or horseshoe-shaped lock springs 60, one such spring associated with each of liners 20 and 22 and positioned between the sidewalls 14 and 18 and their associated, adjacent liners 20 and 22. A first end of each lock spring is fixed to the associated liner and the second end of the lock spring is attached to the lock bar 26 so that the lock bar is always driven in the "forward" direction by the springs—that is, in the direction from the handle 12 toward the tip of the blades 15 and 16 when the blade(s) are in the open position. The lock bar 26 and the springs that act on the lock bar 26 to lock the blades 15 and 16 in the open position, for example as shown in U.S. Pat. No. RE 41,259. When one or both of the blades 15 or 16 is fully open, e.g. in the open position, the lock bar 26 is driven forward and interacts with a ramped portion 32 of blade 15 and/or ramped portion 33 of blade 16 to lock the blade(s) open. An open blade stop pin 30 stops rotation of blades 15 and 16 in the open position, at which a shoulder 34 or 35 on the blades 15 and 16 abuts the open blade stop pin 30.

As disclosed, the folding knife 10 includes a closed blade retention system. As part of the closed blade retention system, the liners 20 and 22 include detent arms 40 and 42 that include a rearward end coupled to the liners 20 and 22 and a free end that retains detent balls 44 and 49. The detent balls 44 and 49 interact with detent holes 48 (only one illustrated in FIG. 1) on the tang of blades 15 and 16 when the blades 15 and 16 are in the closed position. The interaction of the detent balls 44 and 49 and the detent holes 48 serve to retain the blades 15 and 16 in the closed position until such time as a user moves one or both of blades 15 and 16 towards the open position. The detent arms 40 and 42 on the liners restrain a closed blade from opening while the other blade is opening/closing. The detent balls 44 and 49 at the ends of the detent arms 40 and 42 press into the detent holes 48 located on the tang of the blades 15 and 16, keeping the closed blade from swinging freely.

The knife 10 further includes a secondary stop pin 50, the purpose of which will become apparent in the following discussion.

Figure 3:
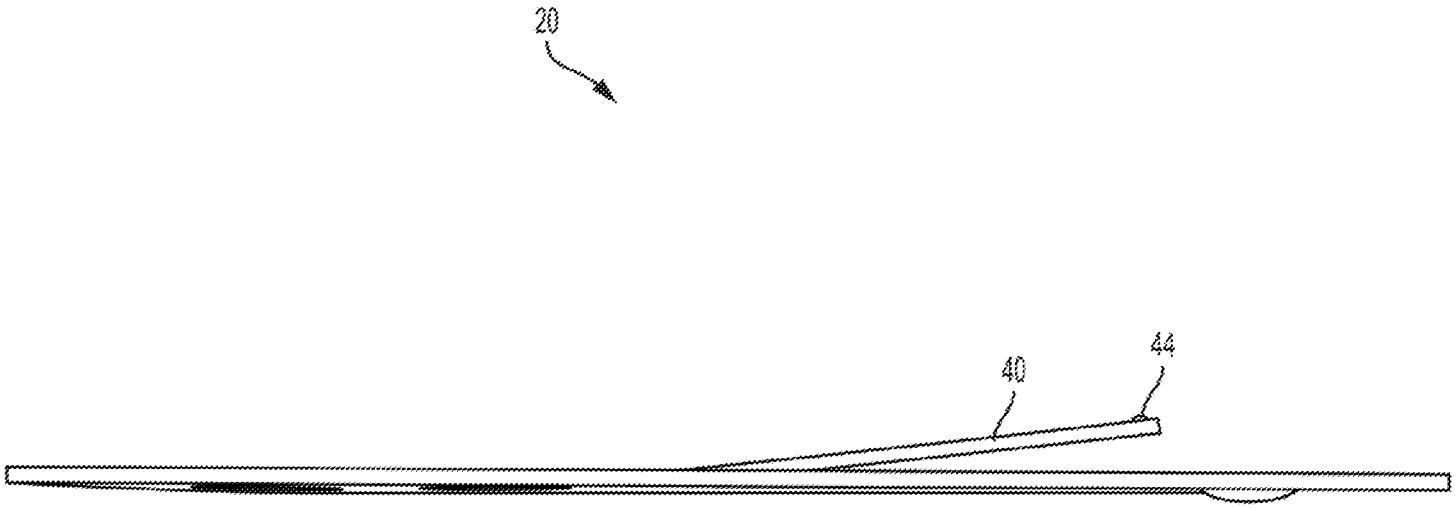
FIG. 3 top view of a liner of the knife shown in FIG. 1 showing the bend of a detent arm, in accordance with various embodiments.

FIG. 3 shows a liner 20 with an integral detent arm 40 coupled thereto. As shown in FIG. 3, the detent arm 40, including the detent ball 44 is lightly bent away from the front to back axis of the liner 20. Inclusion of this slight bend transforms the detent arm 40 into a leaf spring and provides the force to hold the detent ball in a detent hole present on the tang of the blade. In certain embodiments, the detent arm 40 provides between about 1.5 lbs and 2.5 lbs of force or pressure.

Figure 4:
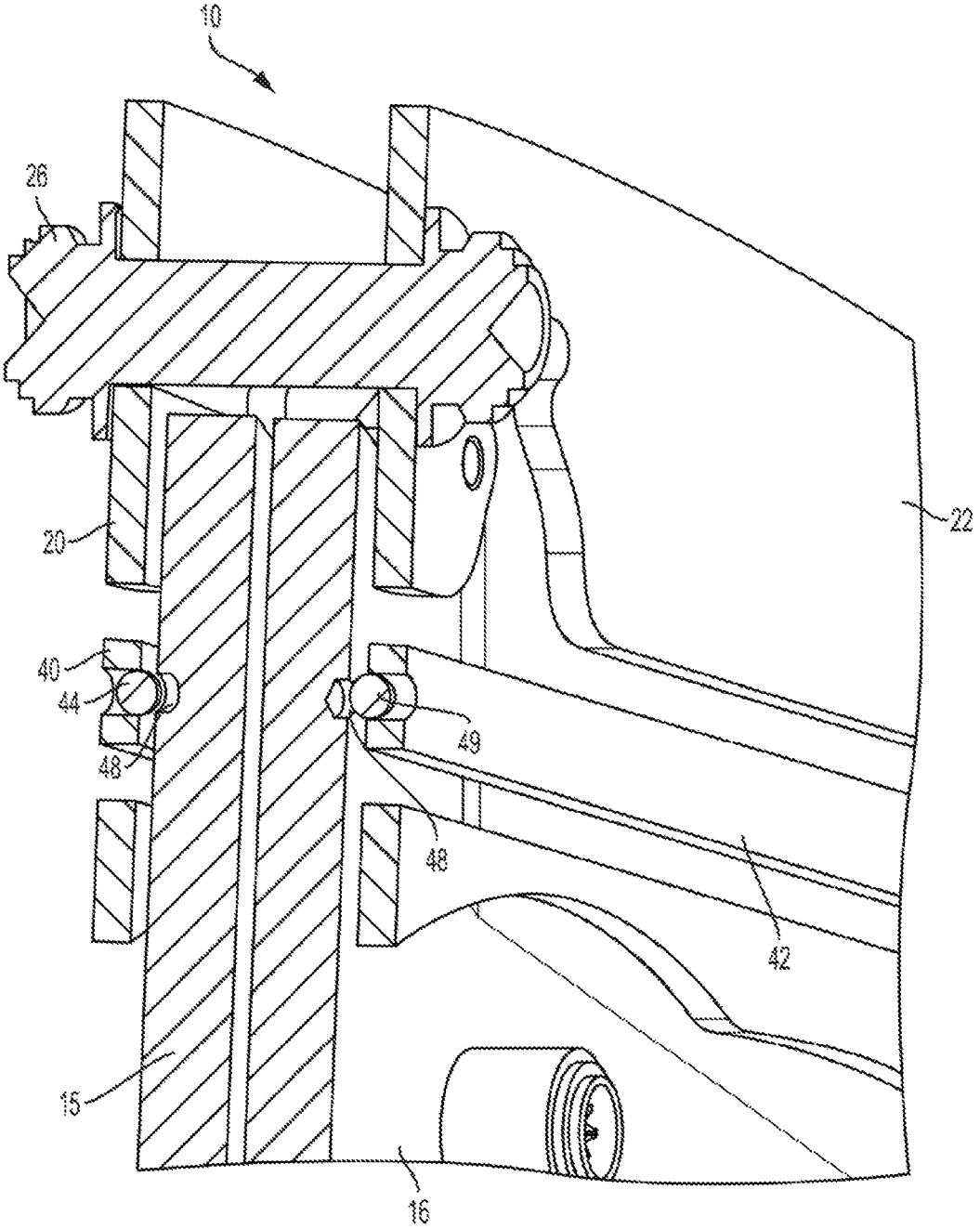
FIG. 4 is a cross sectional view of the knife shown in FIG. 1 with the blades in the folded, closed position, in accordance with various embodiments.
Figure 5:
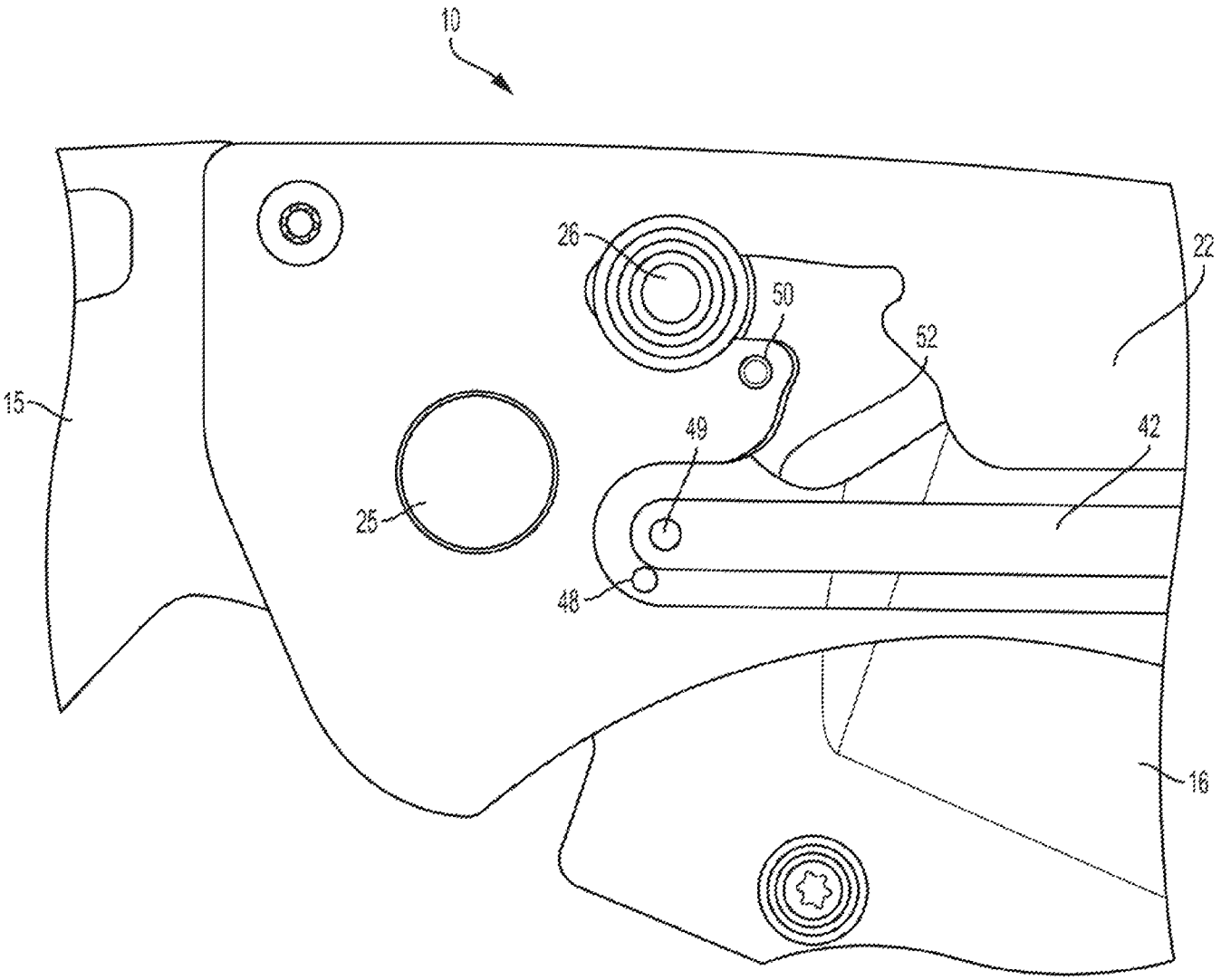
FIG. 5 is a side elevation view of the knife shown in FIG. 1 focusing on the blade lock and blade retention mechanisms, in accordance with various embodiments.

FIG. 4 shows a cross-sectional view of the knife 10 as taken on a transverse plane through the detent balls 44 and 49. The knife 10 is shown with both blades 15 and 16 in the closed position with the detent balls 44 and 49 fully engaged with detent holes 48 present in the tangs of the blades 15 and 16. The leaf spring action of the detent arms 40 and 42 hold the detent balls 44 and 49 in the detent holes 48, effectively holding the blades 15 and 16 in the closed position. The pressure applied by the detent arms 40 and 42 is just enough to hold the blades 15 and 16 in the closed position until a user manually moves the blades 15 and 16 out of the closed position to the fully extended or open, locked position.

Figure 6A:
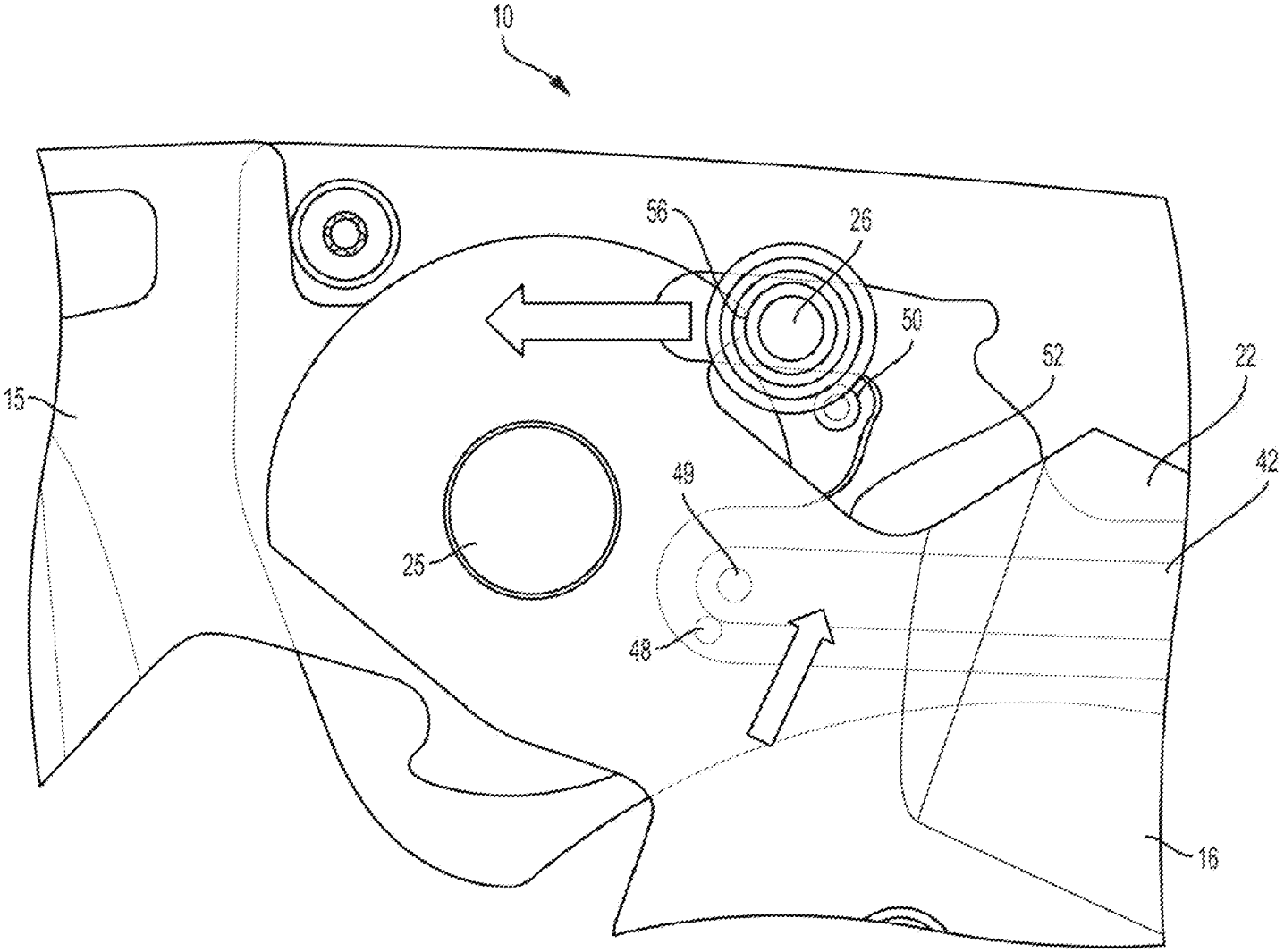
FIGS. 6A, 6B and 6C are a sequential series of side elevation views showing the operation of the locking and blade retention mechanisms of the knife shown in FIG. 1, in accordance with various embodiments.
Figure 6B:
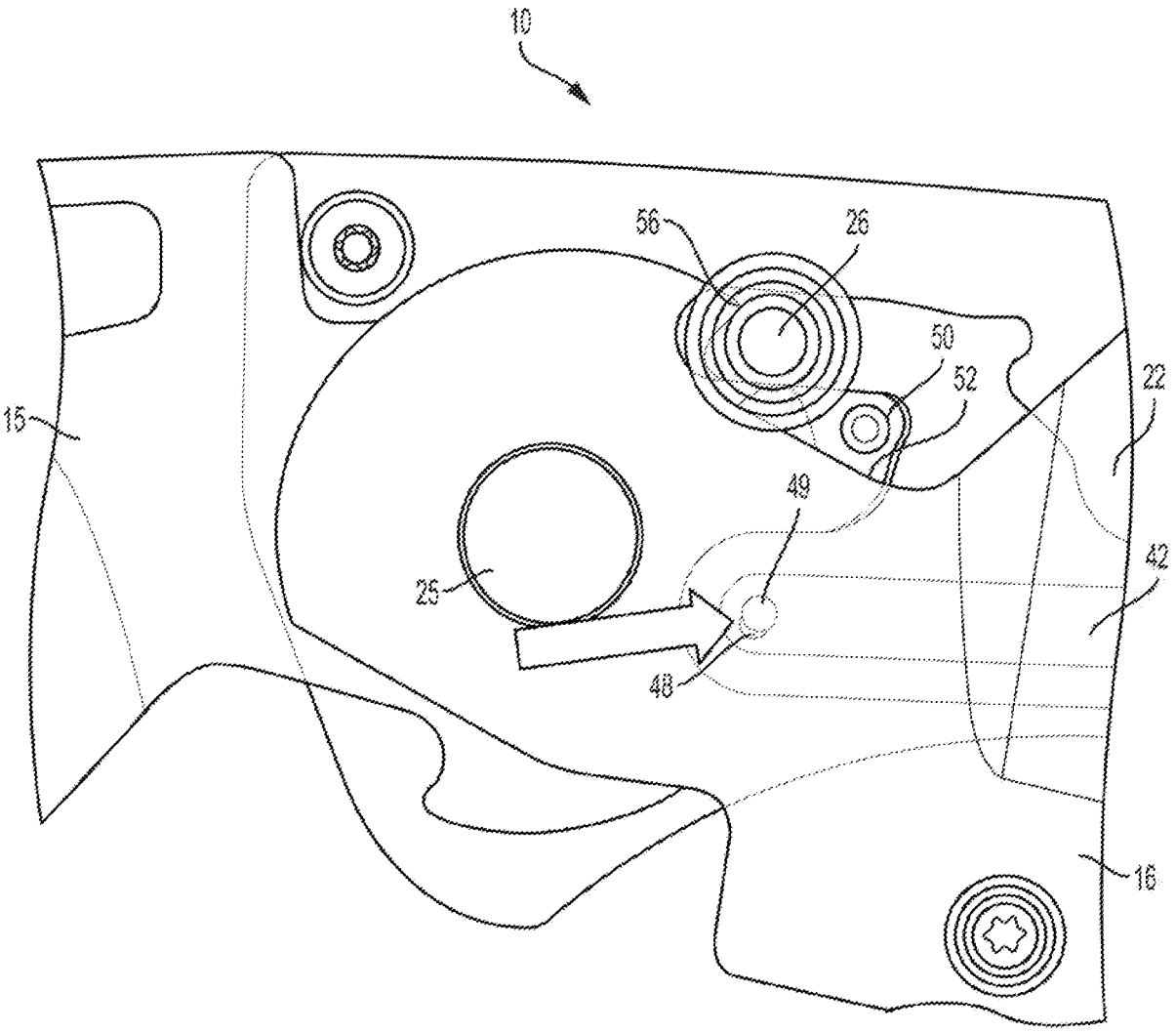
Figure 6C:
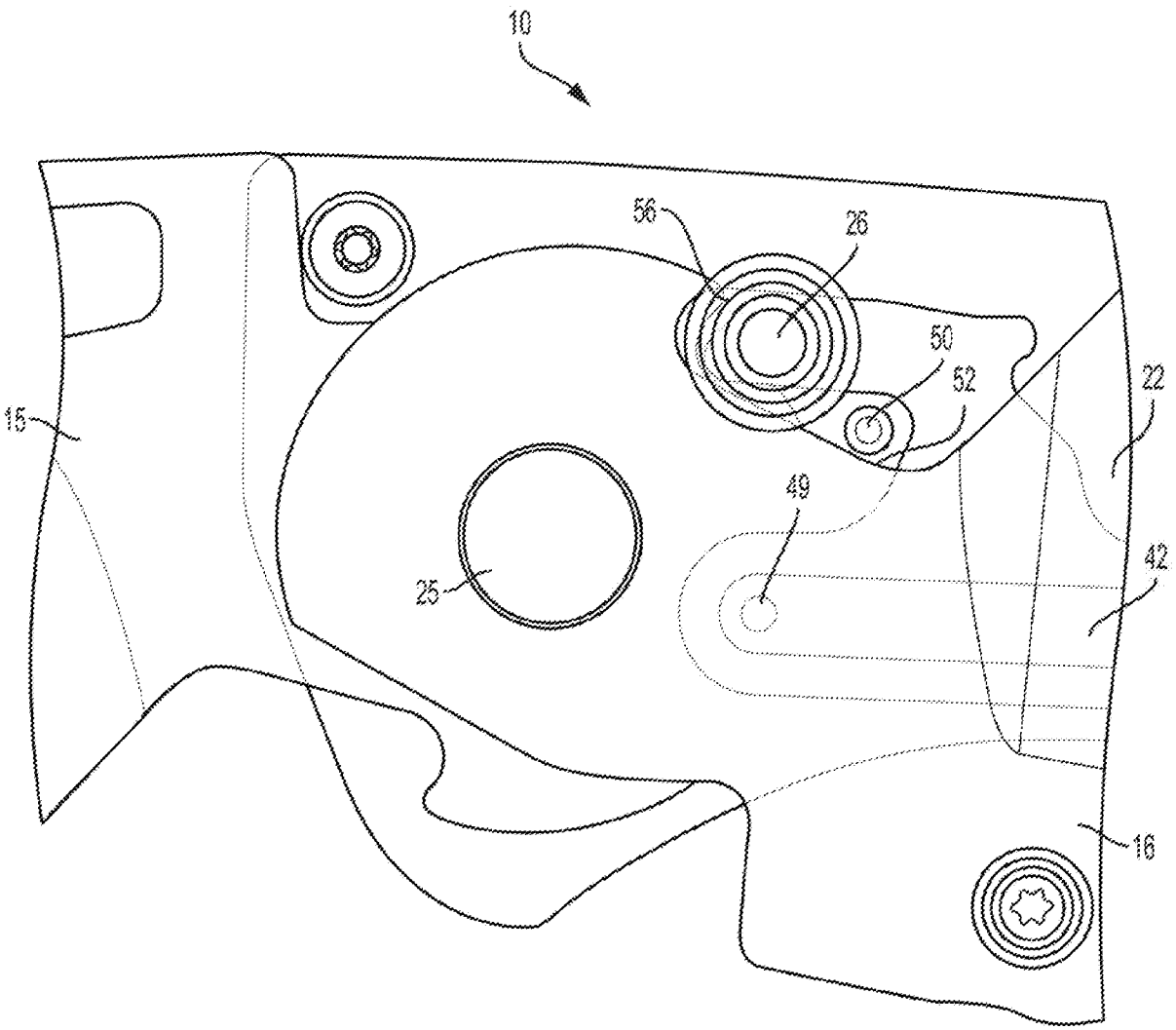

FIG. 5 and FIGS. 6A-6C show a side elevation view of the knife 10, focusing on the blade retention system, with the sidewalls removed for clarity. FIGS. 6A-6C depict side elevation views of the knife 10 showing the sequential action of the locking mechanism and blade retention system as the blade 16 is moved into the fully closed position. The timing and dimensionality of the mechanism provides for precision closing of the blades.

FIG. 6A shows the primary suck back (suck back refers to the lock bar mechanism biasing the blades to the closed position until the blade is rotated past a specific point) from the lock bar 26 which is biased toward the front of the knife 10 in the direction of the arrow. The lock bar 26 pushes on the tang hook 56 and rotates the closing blade 16 just before the lock bar 26 locks the open blade 15.

As shown in FIG. 6B, when the lock bar 26 locks the open blade 15, it stops producing suck back for the closed blade 16. However, just before this point, the blade 16 is rotated so that the centerline of the detent ball 49 is past the edge of the detent hole 48 on the tang of the closed blade 16.

As shown in FIG. 6C, the detent hole 48 then finishes the last bit of suck back, and retains the closed blade 16 with the desired bias toward the closed position using the pressure of the detent arm 42.

Figure 7:
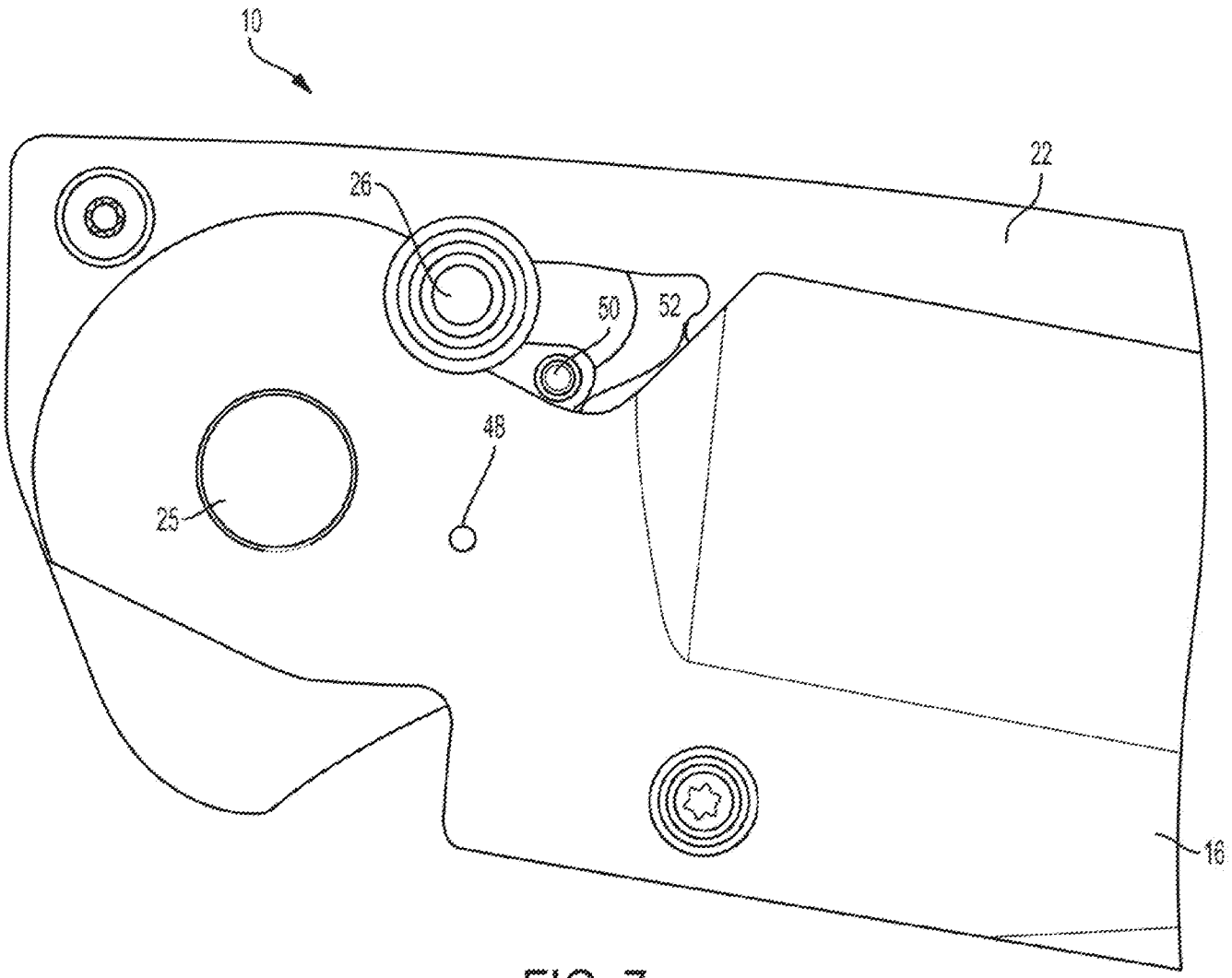
FIGS. 7 and 8 are side elevation views of the knife shown in FIG. 1 focusing on the second blade stop, in accordance with various embodiments.
Figure 8:
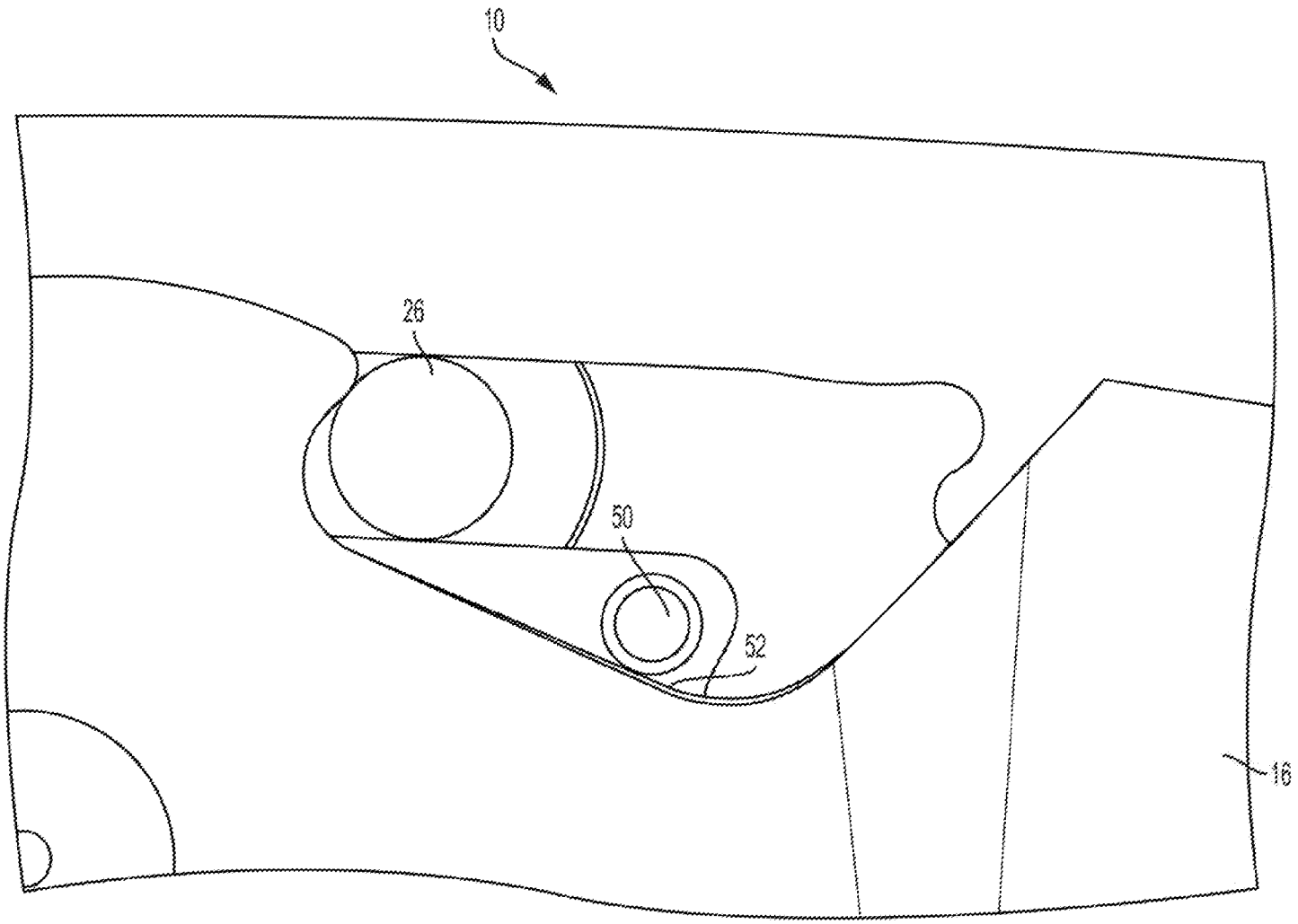

FIGS. 7 and 8 are side elevation views of the knife 10 focusing on the position of the closed bade 16 and the secondary stop pin 50, which interacts with the tang of a blade when the blade is in the closed position. During development of the disclosed knife it was found that resting a closed blade on the lock bar (which is typical in single blade knifes) caused slight binding of the lock bar mechanism, inhibiting the movement of the lock bar. The secondary stop pin 50 is included to provide a resting spot for a closed blade 16, such that the closed blade 16 is not resting on the lock bar 26. The tang of the blade 16 includes a ramped surface 54 that rests against the secondary stop pin 50. A similar ramped surface 52 is present on blade 15. As is shown in FIG. 8, the above-described arrangement frees the lock bar from the dual purpose of locking the open blade and providing a resting place for the closed blade.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A folding tool comprising:

a handle having a first handle half and a second handle half held in a spaced apart relationship to form an implement groove therebetween;

two or more implements pivotally connected between the first handle half and the second handle half by a pivot shaft and movable between an open position and a closed position, the two or more implements each having a tang and a working portion;

a lock bar that is movable between a first position and a second position, wherein the first position locks one or more of the implements in the open position, and moving the lock bar to the second position releases the one or more implements from being locked in the open position; and a closed implement retention system, comprising:

a detent feature on each tang;

a detent retainer spring;

a detent ball, wherein when at least one of the two or more implements is in the closed position, the detent feature aligns with the detent ball thereby retaining the at least one implement in the closed position.

2. The folding tool of claim 1, wherein the detent retainer spring comprises a leaf spring, wherein the leaf spring is coupled to the detent ball.

3. The folding tool of claim 1, wherein the first handle half and the second handle half each comprise a sidewall and a liner, and wherein each liner has the detent retainer spring coupled thereto.

4. The folding tool of claim 3, wherein the detent retainer spring and its respective liner are a single integral piece of material.

5. The folding tool of claim 1, wherein the detent feature comprises a hole, wherein the detent ball is coupled to the detent retainer spring and engageable with the hole.

6. The folding tool of claim 1, wherein the two or more implements are separated from each other by a bearing or bushing.

7. The folding tool of claim 6, wherein the bearing is a thrust bearing.

8. The folding tool of claim 1, wherein the lock bar is biased to the first position by one or more springs.

9. The folding tool of claim 1, further comprising a closed position stop, wherein the tang of each of the two or more implements rests against the closed position stop in the closed position and does not rest against the lock bar.

10. The folding tool of claim 9, wherein at least one of the tangs comprises a first ramped surface that interacts with the lock bar in the open position.

11. The folding tool of claim 10, where at least one of the tangs comprises a second ramped surface that interacts with the closed position stop in the closed position.

12. The folding tool of claim 1, wherein the closed implement retention system exerts between 1.5 and 2.5 lbs of force.

13. The folding tool of claim 1, wherein the one or more of the two or more implements comprises a knife blade.

* * * * *